US008067344B2

(12) United States Patent
Shimura et al.

(10) Patent No.: US 8,067,344 B2
(45) Date of Patent: Nov. 29, 2011

(54) LUBRICATING GREASE COMPOSITION

(75) Inventors: Akihiko Shimura, Ibaraki (JP); Tetsuhiro Kitahara, Ibaraki (JP); Tatsuya Hashimoto, Ibaraki (JP)

(73) Assignee: NOK Kluber Co., Ltd., Tokyo (JP)

( * ) Notice: Subject to any disclaimer, the term of this patent is extended or adjusted under 35 U.S.C. 154(b) by 0 days.

(21) Appl. No.: 12/762,527

(22) Filed: Apr. 19, 2010

(65) Prior Publication Data

US 2010/0298182 A1 Nov. 25, 2010

Related U.S. Application Data

(63) Continuation of application No. 11/630,463, filed as application No. PCT/JP2005/011257 on Jun. 20, 2005, now abandoned.

(30) Foreign Application Priority Data

Jun. 25, 2004 (JP) ..... 2004-187354

(51) Int. Cl.
*C10M 169/02* (2006.01)
*C10M 157/02* (2006.01)

(52) U.S. Cl. ..... 508/182; 508/181

(58) Field of Classification Search ..... 508/181, 508/182, 582, 588, 589, 590
See application file for complete search history.

(56) References Cited

U.S. PATENT DOCUMENTS

| | | | | |
|---|---|---|---|---|
| 3,793,197 | A * | 2/1974 | Chapman | 508/138 |
| 5,494,742 | A * | 2/1996 | Seki et al. | 428/332 |
| 5,914,548 | A * | 6/1999 | Watanabe et al. | 310/88 |
| 5,948,737 | A | 9/1999 | Srinivasan et al. | |
| 6,525,908 | B1 * | 2/2003 | Usuki | 360/133 |
| 6,534,424 | B2 * | 3/2003 | Fu et al. | 438/791 |
| 6,673,750 | B2 | 1/2004 | Hirata et al. | |
| 2003/0040442 | A1 | 2/2003 | Yokouchi et al. | |
| 2004/0186025 | A1 * | 9/2004 | Nakatani et al. | 508/130 |
| 2008/0167208 | A1 | 7/2008 | Hashida et al. | |

FOREIGN PATENT DOCUMENTS

| | | |
|---|---|---|
| JP | 59-189511 | 10/1984 |
| JP | 61-113694 | 5/1986 |
| JP | 2001-354986 | 12/2001 |
| JP | 2003-027079 | 1/2003 |
| JP | 2003-096480 | 4/2003 |
| JP | 2003176831 A * | 6/2003 |
| JP | 2004-124050 | 4/2004 |
| JP | 2004-162909 | 6/2004 |

OTHER PUBLICATIONS

Toyota Emissions, Emissions #2-Emissions analysis.*
Bearing 6204ZZ.*
Fomblin PFPE Lubricants, www.solvaysolexis.com, modified Dec. 13, 2002, pp. 1-4.
Translation of JP2001354986, Akihiko Shimura et al. Dec. 25, 2001.

* cited by examiner

*Primary Examiner* — Cephia D Toomer
*Assistant Examiner* — Pamela H Weiss
(74) *Attorney, Agent, or Firm* — Brinks Hofer Gilson & Lione

(57) ABSTRACT

A lubricating grease composition, which comprises a base oil consisting of a mixture of 100 parts by weight of at least one of a perfluoropolyether oil (A), represented by $RfO[CF(CF_3)CF_2O]_p(CF_2CF_2O)_qRf$ (where Rf is a perfluoroalkyl group having 1-5 carbon atoms, p+q=2-200, q/p=0-2, and q may be 0), and a perfluoropolyether oil (B), represented by $F(CF_2CF_2CF_2O)_sC_2F_5$ (where s=2-100), and 0-100 parts by weight of at least one of a perfluoropolyether oil (C), represented by $RfO(CF_2CF_2O)_m(CF_2O)_nRf$ (where m+n=3-200 and m:n=10-90:90-10), and a perfluoropolyether oil (D), represented by $RfO[CF(CF_3)CF_2O]_a(CF_2CF_3O)_b(CF_2O)_cRf$ (where a+b+c=3-200, b is 0 or an integer of 1 or more, and c is an integer of 1 or more), preferably further admixed with a thickening agent, can suppress corrosion of metallic materials by corrosive gases and also has a good heat resistance.

3 Claims, No Drawings

LUBRICATING GREASE COMPOSITION

RELATED APPLICATION

This application is a continuation of U.S. patent application Ser. No. 11/630,463, filed Dec. 21, 2006 now abandoned which is 35 U.S.C. §371 national phase filing of International Patent Application No. PCT/JP2005/011257, filed Jun. 20, 2005, to which priority of each is claimed under 35 U.S.C. §120 and through which and to which priority is claimed under 35 U.S.C. §119 to Japanese Patent Application No. 2007-199089, filed Jul. 31, 2007.

TECHNICAL FIELD

The present invention relates to a lubricating grease composition, and more particularly to a lubricating grease composition having a metal surface protective action against corrosive gases such as a sulfide gas, etc.

BACKGROUND ART

Greases are widely used in various machines and tools such as automobiles, electric.electronic machines and instruments, construction machinery, industrial machinery, machine tools, information-systems, and also parts as their structural components. Recent trend towards making these machines and tools work faster together with more size reduction, higher performance, and lighter weight, etc., inevitably makes the temperatures of the peripheral machines and tools higher and higher. To meet the requirements for lighter weight, lower cost, tighter sealing, etc., molding products of resins or rubber have been much more used, and also to meet the requirement for further quietness improvement, much tighter sealing is desired.

The metallic parts are often to be exposed to the atmosphere of corrosive gases generated from components, etc. contained in resins or rubber, for example, a sulfide gas, a hydrogen chloride gas, a sulfer dioxide gas, ammonia, oxygen, etc., due to such use conditions as higher temperatures and tighter sealing and are also often to be exposed to such corrosive gases permeated from the outside due to severe use conditions.

To solve such problems, it has been proposed to use a grease comprising a fluorosilicone oil and a fluoro resin to suppress hydrogen sulfide permeation and prevent corrosion of contact materials. Besides the fluorosilicone oil, it is said that such fluorine-containing compounds as fluorocarbon, fluoro ester, fluorine-modified paraffin oil, fluorine-modified ester oil, etc. also have the similar effect. However, not all of these fluorine-containing compounds have the effect on the suppression of hydrogen sulfide permeation at the same degree. In this connection, it should be noted that the fluorosilicone oil can suppress the hydrogen sulfide permeation, but has a poor abrasion resistance, resulting in abrasion of contact materials. The fluoro ester, fluorine-modified paraffin oil, and fluorine-modified ester oil have a poor heat resistance, and thus cannot be used in a higher temperature atmosphere as a problem.

Patent Literature 1: JP-A-59-189511

As to the fluorine-based grease, it has been proposed to use a fluorine-based grease comprising a perfluoropolyether oil having repeating units, represented by $(CF_2CF_2CF_2O)_{n'}$ as a base oil to improve the heat resistance and chemical resistance, where no reference is made to the permeation resistance to the corrosive gases.

Patent Literature 2: JP-B-2-32314

Another fluorine-based grease having distinguished washability, abrasion resistance, leakage resistance, etc. has been also proposed, where no reference is also made to the corrosion resistance to corrosive gases, in this case.

Patent Literature 3: JP-A-2001-354986

DISCLOSURE OF THE INVENTION

Problem to be Solved by the Invention

An object of the present invention is to provide a lubricating grease composition capable of suppressing corrosion of metallic materials, caused by corrosive gases, and also having a heat resistance.

Means for Solving the Problem

The object of the present invention can be attained by a lubricating grease composition, which comprises a base oil consisting of a mixture of 100 parts by weight of at least one of a perfluoropolyether oil (A), represented by the following general formula:

$$RfO[CF(CF_3)CF_2O]_p(CF_2CF_2O)_qRf$$

(where Rf is a perfluoroalkyl group having 1-5 carbon atoms, p+q=2-200, q/p=0-2, q can be 0, and $CF(CF_3)CF_2O$ group and $CF_2CF_2O$ group are bonded at random in the main chain), and a perfluoropolyether oil (B), represented by the following general formula:

$$F(CF_2CF_2CF_2O)_sC_2F_5$$

(where s=2-100), and 0-100 parts by weight of at least one of a perfluoropolyether oil (C), represented by the following general formula:

$$RfO(CF_2CF_2O)_m(CF_2O)_nRf$$

(where Rf has the same meaning as defined above, m+n=3-200, m:n=10-90:90-10, and $CF_2CF_2O$ group and $CF_2O$ group are bonded at random in the main chain), and a perfluoropolyether oil (D), represented by the following general formula:

$$RfO[CF(CF_3)CF_2O]_a(CF_2CF_2O)_b(CF_2O)_cRf$$

(where Rf has the same meaning as defined above, a+b+c=3-200, b is 0 or an integer of 1 or more, c is an integer of 1 or more, and $CF(CF_3)CF_2O$ group, $CF_2CF_2O$ group, and $CF_2O$ group are bonded at random in the main chain). The present lubricating grease composition can generally further contain a thickening agent in a proportion of 0.1-50% by weight on the basis of the total of the composition.

Effect of the Invention

The present lubricating grease composition can be effectively used as a metal surface protecting agent for metallic materials to be exposed to the atmosphere of corrosive gases including a sulfide gas (sulfur-containing gases such as a hydrogen sulfide gas, a carbon disulfide gas, etc.), a hydrogen chloride gas, a sulfur dioxide gas, ammonia, etc., together with a satisfactory heat resistance, when used in the fields, to which the perfluoropolyether oil has been so far applied.

Specifically, the present lubricating grease composition can be used to lubricate and protect sliding parts and contact parts between the individual members of ball-and-roller bearings, plain bearings, sintered bearings, gears, valves, cocks, oil seals, electric contacts, etc. For example, the present lubricating grease composition can be used to effectively protect metal surfaces used in the bearings requiring a heat resistance, a low-temperature durability, a load resistance, etc. as in automobile hub units, traction motors, fuel. injection units, alternators, etc.; the gears requiring a high abrasion resistance, low friction characteristics and a high torque efficiency as in automobile power transmission units, power window motors, wipers, etc.; the bearings requiring a low torque and low outgassing properties as in hard discs, flexible disc memory devices, compact disc drives, optomagnetic disc drives, etc. in the information systems; sliding parts of bearings or gears as used in vacuum pumps, resin manufacturing apparatuses, conveyers, lumber industry machines and tools, chromium coating apparatuses, etc.; and electric contacts of electric machines and instruments as used in breakers, relays, switches, etc.

BEST MODES FOR CARRYING OUT THE INVENTION

Perfluoropolyether oils (A)-(D) can be obtained m the following manner, where the perfluoroalkyl group Rf for use herein generally includes a perfluoromethyl group, a perfluoroethyl group, a perfluotopropyl group, etc.

Perfluoropolyether oil (A): obtainable by complete fluorination of precursor, obtained by photo-oxidation polymerization of hexafluoropropylene, or both of hexafluoropropylene and tetrafluoroethylene, or by fluorine gas treatment of an acid fluoride compound having a terminal $CF(CF_3)COF$ group resulting from anionic polymerization of hexafluoropropylene oxide or both of hexafluoropropylene oxide and tetrafluoroethylene oxide in the presence of a cesium fluoride catalyst. The resulting products having a dynamic viscosity of 5-2,000 $mm^2$/sec. at 40° C. are available and can satisfy the conditions of p+q=2-200 and q/p=0-2 in the general formula for perfluoropolyether oil (A).

Perfluoropolyether oil (B): obtainable by anionic polymerization of 2,2,3,3-tetrafluorooxetane in the presence of a cesium fluoride catalyst, followed by a fluorine gas treatment of the resulting fluorine-containing polyether $(CH_2CF_2CF_2O)_n$ under ultraviolet irradiation at 160°-300° C. The resulting products having a dynamic viscosity of 5-2,000-$mm^2$/sec. at 40° C. are available, and can satisfy the condition of s=2-100 in the general formula for perfluoropolyether oil (B).

Perfluoropolyether oil (C): obtainable by photo-oxidation polymerization of tetrafluoroethylene. The resulting products having a dynamic viscosity of 5-2,000 $mm^2$/sec. at 40° C. are available and can satisfy the conditions of m+n=3-200 and m:n=10-90:90-10 in the general formula for perfluoropolyether oil (C).

Perfluoropolyether oil (D): obtainable by photo-oxidation of hexafluoropropene and tetrafluoroethylene. The resulting products having a dynamic viscosity of 5-2,000 $mm^2$/sec. at 40° C. are available, and can satisfy the condition of a+b+c=3-200 in the general formula for perfluoropolyether oil (D).

The perfluoropolyether oils (A) and (B) can prevent permeation of corrosive gases (a sulfide gas, a hydrogen chloride gas, a sulfur dioxide gas, ammonia, etc.), compared with perfluoropolyether oils of other structures. The suppression effect on corrosive gases is due to the C—F bonds in the molecule. Perfluoropolyether oil (C) of other structure having random bonds of $CF_2O$ groups has the highest viscosity index, a low volatility, and a low friction coefficient among the perfluoropolyether oils, but the presence of $CF_2O$ groups in the molecule weakens the permeation preventive effect of C—F bonds on corrosive gases, resulting in corrosion of metallic pieces. Likewise, perfluoropolyether oil (D) containing $CF_2O$ groups has a distinguished abrasion resistance, but permits permeation of corrosive gases, resulting in corrosion of metals.

At least one of perfluoropolyether oils (A) and (B) is mixed with perfluoropolyether oils of other structures containing random bonds $CF_2O$ groups to make a base oil, thereby providing the base oil with properties having both advantages. For example, a mixture of 100 parts by weight of at least one of perfluoropolyether oils (A) and (B) with 0-100 parts by weight, preferably 2-100 parts by weight, more preferably 5-75 parts by weight, of at least one of perfluoropolyether oils (C) and (D) of other structures having a random bond of $CF_2O$ groups can prevent permeation of corrosive gases and also can show a low friction property. Particularly, component (C) has such characteristics as a high viscosity index, a low volatility, a low friction coefficient, etc., and these advantages can be given to the lubricating grease composition by using component (C) together with components (A) and (B). Under more severe conditions, a proportion of perfluoropolyether oils (C) and (D) of other structures having a random bond of $CF_2O$ groups can be reduced.

On the other hand, fluoro oils having no ether bonds have poor viscosity index, abrasion resistance and friction resistance, giving rise to poor conduction due to abrasion of contact materials, an increase in the friction coefficient at low temperatures, etc. Thus, perfluoropolyether oils (A) and (B) property containing ether bonds in the molecule and having a random bond of $CF(CF_3)CF_2O$ groups and $CF_2CF_2O$ groups in the main chain can have such characteristics as good viscosity index, abrasion resistance and friction resistance together, while maintaining a distinguished suppression effect on the permeation of corrosive gases, whereby a reduction effect on the corrosion or abrasion at contact parts can be brought about. These two perfluoropolyether oils (A) and (B) can be used as a base oil upon mixing in any desired proportion thereof.

Base oil consisting of these perfluoropolyether oils (A), (B), (C), and (D) having a dynamic viscosity of 5-2,000 $mm^2$/sec., preferably 5-1,500 $mm^2$/sec. at 40° C. (as determined according to JIS K2283) can be used. When the dynamic viscosity is less than 5 $mm^2$/sec., there are high risks of increasing the evaporation loss, lowering the oil film strength, etc. and giving rise to such inconveniences as lowering of the life, and causing abrasion and seizure. Above 2,000 $mm^2$/sec., on the other hand, there are high risks of increasing a viscous drag, etc. and giving rise to such inconveniences as increased power consumption or torque. A portion of the perfluoropolyether oils (A) and (B) can be replaced with poly(α-olefin) oil, etc. having such a dynamic viscosity as in the above-mentioned range.

The base oil can further contain a thickening agent, and the preferable thickening agent is fluoro resin. The fluoro resin for use herein includes polytetrafluoroethylene, tetrafluoroethylene-hexafluoropropene copolymer, perfluoroalkylene resin, etc., which have been so far used as a lubricant. Polytetrafluoroethylene for use herein is those having a number average molecular weight Mn of about 1,000 to about 500,000, prepared by emulsion polymerization, suspension polymerization, solution polymerization, or the like of tetrafluoroethylene, thereby forming polytetrafluoroethylene having a number average molecular weight Mn of about 1,000 to about 1,000,000, followed by a thermal decomposition treatment, a decomposition treatment by electron beam irradiation, a physical pulverizing treatment or the like. Copolymerization reaction of tetrafluoroethylene and hexafluoropropene, and successive treatment of making the molecular weight lower can be carried out in the same manner as in the case of polytetrafluoroethylene, and the copolymers having a number average molecular weight Mn of about 1,000 to about 600,000 can be used. Control of the molecular weight can be also made by use of a chain transfer agent at copolymerization reaction. The resulting powdery fluoro resin has an average primary particle size of generally about 500 μm or less, preferably about 0.1-30 μm.

Other thickening agents for use herein than the fluoro resin include metal soap such as Li soap, etc., urea resin, minerals such as bentonite, etc., organic pigments, polyethylene, polypropylene, polyamide, etc., and it is preferable from the viewpoint of heat resistance and lubricability to use aliphatic dicarboxylic acid metal salts, monoamide monocarboxylic acid metal salts, monoester carboxylic acid metal salts, diurea, triurea, tetraurea, etc.

These powdery fluoro resin, metal soap, urea, and other thickening agents can be admixed in a proportion of 0.1-50% by weight, preferably 10-40% by weight, on the basis of the total of the composition consisting of the base oil of perfluoropolyether oils and the thickening agents. Above 50% by weight, the composition will be too hard, whereas below 0.1% by weight the thickening effect of the fluoro resin is not brought about, resulting in deterioration of base oil such as separation of oil, and any increase in the scattering and leakage prevention is no more expectable.

The lubricating grease composition can further contain such additives so far added to the lubricant as an antioxidant, an antirust agent, a corrosion inhibitor, an extreme pressure agent, an oiliness agent, a solid lubricant, etc. The antioxidant includes, for example, a phenol-based antioxidant such as 2,6-di-t-butyl-4-methylphenol, 4,4'-methylenebis(2,6-di-t-butylphenol), etc., and an amine-based antioxidant such as alkyldiphenylamine, triphenylamine, phenyl-α-naphthylamine, phenothiazine, alkylated-α-naphthylamine, alkylated phenothiazine, etc.

The antirust agent includes, for example, fatty acid, fatty acid amine, alkylsulfonic acid metal salts, alkylsulfonic acid amine salts, oxidized paraffin, polyoxyethylene alkyl ethers, etc., and the corrosion inhibitor includes, for example, benzotriazole, benzimidazole, thiadiazole, etc.

The extreme pressure agent includes, for example, a phosphorus-based compound such as phosphoric acid esters, phosphorous acid esters, phosphoric acid amine salts, etc., a sulfur-based compound such as sulfides, disulfides, etc., dialkyldithiophosphoric acid metal salts, dialkyldithiocarbamic acid metal salts, etc.

The oiliness agent includes, for example, fatty acids or their esters, higher alcohols, polyhydric alcohols or their esters, aliphatic amines, aliphatic acid monoglycerides, etc.

The solid lubricant includes, for example, molybdenum disulfide, graphite, boron nitride, silane nitride, etc.

The composition can be prepared in the following manner: (a) by admixing a predetermined amount of perfluoropolyether base oil with a predetermined amount of a thickening agent, followed by thorough kneading through three rolls or by a high pressure homogenizer, (b) by adding perfluoropolyether oils and aliphatic carboxylic acid to a heatable, stirrable reactor vessel, thereby heating and melting the mixture, and adding a predetermined amount of a metal hydroxide (and an amide compound or an alcohol compound) thereto, thereby conducting a metal salt-forming reaction (and amidation reaction or esterification reaction), followed by cooling and thorough kneading through three rolls or by a high pressure homogenizer, or (c) by adding perfluoropolyether oils and an isocyanate to a heatable, stirrable reactor vessel, heating the mixture, and adding a predetermined amount of an amine thereto, thereby conducting reaction, followed by cooling and thorough kneading through three rolls, or by a high pressure homogenizer.

EXAMPLES

The present invention will be described in detail below, referring to Examples, which are not restrictive of the present invention. In the following Examples and Comparative Examples, "%" are by weight, unless otherwise specifically mentioned.

Examples 1 to 10, and Comparative Examples 1 to 4

[Base oil]

| | Dynamic Viscosity (40° C.) |
|---|---|
| A-I: $RfO[CF(CF_3)CF_2O]_pRf$ (component A) | 100 $mm^2$/sec. |
| A-2: $RfO[CF(CF_3)CF_2O]_pRf$ (component A) | 400 $mm^2$/sec. |
| A-3: $RfO[CF(CF_3)CF_2O]_a(CF_2O)_cRf$ (component D) | 400 $mm^2$/sec. |
| A-4: $RfO(CF_2CF_2O)_m(CF_2O)_nRf$ (component C) | 85 $mm^2$/sec. |
| A-5: $F(CF_2CF_2CF_2O)\bullet C_2F_5$ (component B) | 65 $mm^2$/sec. |
| A-6: poly(α-olefin) oil | 30 $mm^2$/sec. |
| A-7: fluorosilicone oil | 300 $mm^2$/sec. |

[Thickening Agent]

B-1: Emulsion polymerization polytetrafluoroethylene (Mn: about $100\times10^3$ to about $200\times10^3$; average primary particle size: 0.2 μm)

B-2: Suspension polymerization polytetrafluoroethylene (Mn: about $10\times10^3$ to about $100\times10^3$; average primary particle size: 5 μm)

B-3: Solution polymerization tetrafluoroethylene-hexafluoropropene copolymer (Mn: about $50\times10^3$- to $150\times10^3$; average primary particle size: 0.2 μm)

B-4: Lithium azelate

B-5: Reaction product of hexamethylene diisocyanate and octyl-amine

Lubricating grease composition were prepared from combinations of the foregoing base oils and thickening agents, and subjected to evaluation of properties of the compositions according to the following test procedures:

<Sulfide Gas Test>

Testing apparatus: constant flow rate flow type, gas corrosion test apparatus $H_2S$ concentration: 3%

Temperature: 40° C. Humidity: 90%

Time: 96 hours

Test piece: copper plate and silver plate, each 40 mm×40 mm×5 mm in size

Evaluation method: copper plate surface and silver plate surface wiped off the grease after the test were subjected to EDS (energy dispersion type X-ray spectrometry) analysis to make evaluation as to whether sulfur was detected or not on the surfaces <Abrasion Test>

Test apparatus: Shell four-ball test machine

Test piece: SUJ2 (½ inch), grade 20

Revolution rate: 20 revolutions/sec.

Load: 392.3N (40 kgf)

Temperature: room temperature

Time: 60 minutes

The results are shown in the following Table.

TABLE

| | Base oil | Thickening agent | Sulfide gas test | | Abrasion test |
|---|---|---|---|---|---|
| | | | Copper Plate | Silver plate | Abrasion trace size |
| Ex. 1 | (A-I) 70% | (B-1) 30% | ND | ND | 1.0 mm |
| Ex. 2 | (A-2) 60% | (B-2) 40% | " | " | 0.9 mm |
| Ex. 3 | (A-5) 70% | (B-1) 30% | " | " | 1.2 mm |
| Ex. 4 | (A-1) 42%<br>(A-3) 28% | (B-3) 30% | " | " | 1.1 mm |
| Ex. 5 | (A-1) 35%<br>(A-4) 35% | (B-1) 30% | " | " | 0.9 mm |
| Ex. 6 | (A-1) 64%<br>(A-6) 18% | (B-5) 16%<br>(B-1) 2% | " | " | 0.7 mm |
| Ex. 7 | (A-1) 64%<br>(A-6) 18% | (B-5) 8%<br>(B-1) 10% | " | " | 0.9 mm |
| Ex. 8 | (A-2) 42%<br>(A-3) 28% | (B-1) 30% | " | " | 0.9 mm |
| Ex. 9 | (A-5) 35%<br>(A-3) 35% | (B-1) 30% | " | " | 1.1 mm |
| Ex. 10 | (A-5) 42%<br>(A-4) 28% | (B-1) 30% | " | " | 1.0 mm |
| Comp Ex. 1 | (A-3) 70% | (B-1) 30% | D | D | 1.1 mm |
| Comp Ex. 2 | (A-4) 70% | (B-1) 30% | " | " | 1.0 mm |
| Comp Ex. 3 | (A-6) 70% | (B-4) 30% | " | " | 0.5 mm |
| Comp Ex. 4 | (A-6) 91% | (B-5) 9% | " | " | 0.7 mm |
| Comp Ex. 5 | (A-6) 70% | (B-1) 30% | ND | ND | 2.4 mm |

Note)
ND: no detection of sulfur
D: detection of sulfur

The invention claimed is:

1. A method of preventing corrosion of a copper surface or a silver surface by a sulfide gas which method comprises applying a lubricating grease composition to a copper surface or a silver surface, the lubricating grease composition consisting of a fluoro resin and a base oil consisting of a mixture of 100 parts by weight of at least one of a perfluoropolyether oil (A), represented by the following general formula:

$$RfO[CF(CF_3)CF_2O]_p(CF_2CF_2O)_qRf$$

where Rf is a perfluoroalkyl group having 1-5 carbon atoms, p+q=2-200, q/p=0-2, q may be 0, and $CF(CF_3)CF_2O$ group and $CF_2CF_2O$ group are bonded at random in the main chain and a perfluoropolyether oil (B), represented by the following general formula:

$$F(CF_2CF_2CF_2O)_sC_2F_5$$

where s=2-100, and 2-100 parts by weight of at least one of a perfluoropolyether oil (C), represented by the following general formula:

$$RfO(CF_2CF_2O)_m(CF_2O)_nRf$$

where Rf has the same meaning as defined above, m+n=3-200, m:n=10-90:90-10, and $CF_2CF_2O$ group and $CF_2O$ group are bonded at random in the main chain, and a perfluoropolyether oil (D), represented by the following general formula:

$$RfO[CF(CF_3)CF_2O]_a(CF_2CF_2O)_b(CF_2O)_cRf$$

where Rf has the same meaning as defined above, a+b+c=3-200, b is 0 or an integer of 1 or more, c is an integer of 1 or more, and $CF(CF_3)CF_2O$ group, $CF_2CF_2O$ group, and $CF_2O$ group are bonded at random in the main chain, and exposing the copper surface or silver surface having the lubricating grease applied thereto to a sulfide gas whereby the applied lubricating grease prevents corrosion of the copper surface or silver surface by the sulfide gas.

2. A method of preventing corrosion of a copper surface or a silver surface by a sulfide gas according to claim 1, wherein the copper surface or the silver surface to which the lubricating grease composition is applied comprises a sliding surface or contact surface of a ball-and-roller bearing, a plain bearing, a sintered bearing, a gear, a valve, a cocks or an oil seal.

3. A method of preventing corrosion of a copper surface or a silver surface by to a sulfide gas corrosive gases according to claim 1, wherein the copper surface or the silver surface to which the lubricating grease composition is applied comprises an electrical contact.

* * * * *

UNITED STATES PATENT AND TRADEMARK OFFICE

CERTIFICATE OF CORRECTION

PATENT NO. : 8,067,344 B2
APPLICATION NO. : 12/762527
DATED : November 29, 2011
INVENTOR(S) : Akihiko Shimura, Tetsuhiro Kitahara and Tatsuya Hashimoto It is certified that error appears in the above-identified patent and that said Letters Patent is hereby corrected as shown below:

In the Specification

Column 1, line 12, delete "2007-199089, filed Jul. 31, 2007", and insert -- 2004-187354, filed Jun. 25, 2004. --

Column 1, line 24, delete "electric electronic", and insert -- electric • electronic --

Column 8, line 37, delete "corrosive gases"

Signed and Sealed this
Fifth Day of June, 2012

David J. Kappos

David J. Kappos
*Director of the United States Patent and Trademark Office*